US005535108A

United States Patent [19]

Logsdon

[11] Patent Number: 5,535,108

[45] Date of Patent: Jul. 9, 1996

[54] FLEET LIGHT

[76] Inventor: Dana K. Logsdon, 400½ W. Main St., Beardstown, Ill. 62618

[21] Appl. No.: 397,930

[22] Filed: Mar. 3, 1995

[51] Int. Cl.[6] ..... F21L 7/00

[52] U.S. Cl. ..... 362/183; 362/186; 362/398

[58] Field of Search ..... 362/103, 183, 362/398, 431, 196, 276, 158, 421, 186

[56] References Cited

U.S. PATENT DOCUMENTS

| | | | |
|---|---|---|---|
| 3,225,186 | 12/1965 | Duncan | 362/183 |
| 4,177,500 | 12/1979 | Nicholl et al. . | |
| 4,258,414 | 3/1981 | Sokol | 362/398 |
| 4,626,852 | 12/1986 | Dodge . | |
| 4,841,416 | 6/1989 | Doss | 362/183 |
| 5,039,929 | 8/1991 | Veistroffer et al. . | |
| 5,063,483 | 11/1991 | Feilmeier et al. | 362/103 |
| 5,103,383 | 4/1992 | Mayhew . | |
| 5,262,756 | 11/1993 | Chien . | |

FOREIGN PATENT DOCUMENTS

| | | | |
|---|---|---|---|
| 3118694A1 | 12/1982 | Germany . | |
| 134476 | 11/1919 | United Kingdom | 362/183 |
| WO93/254408 | 12/1993 | WIPO . | |

*Primary Examiner*—James C. Yeung
*Attorney, Agent, or Firm*—Richard C. Litman

[57] ABSTRACT

A fleet light for illuminating barges moored on a river which is portable, horizontally illuminates 360°, magnetically positioned, and energized by a rechargeable battery recharged by either a multiple unit recharging device or by an attachable solar cell module.

10 Claims, 3 Drawing Sheets

FLEET LIGHT

BACKGROUND OF THE INVENTION

1. Field of the Invention

The present invention relates to an economical lighting system for use in the marine industry and includes a number of independent rechargeable modular light units capable of 360° illumination and capable of either self-charging by individual solar panels or chargeable by a multiple unit charger. A magnetic attachment can be utilized either on the base or on the side of the battery case for attachment to elevated and metallic supporting surfaces such as barge covers or barge decks.

2. Description of the Prior Art

The pertinent prior art will be discussed in the order of perceived relevance to the present invention.

In U.S. Pat. No. 5,103,383 issued on Apr. 7, 1992, to Donald M. Mayhew, a portable emergency flasher for water craft or vehicles utilizing a strobe light (xenon tube) assembly mounted on a two-piece case which contains a power receptacle above a sealed lead-sulphuric acid battery is described. The battery is recharged by a power source from another battery of the water craft or vehicle. The plastic cover serving as a lens has a ridged surface and can be any color. The use of a flashing light is critical, but a constant beam of white light is not critical. The use of a smooth lens cover is not suggested.

In U.S. Pat. No. 4,177,500 issued on Dec. 4, 1979, to Thomas H. Nicoll et al., a portable power failure light having a square lens cover and a square battery housing is described. The plastic cover has frosted sides and a beam forming top surface. Silvered conical or parabolic reflectors are contemplated for directing the light through the top surface. The battery consists of two nickel-cadmium AA batteries with a voltage of 2.4 to 3 volts which lasts 90 minutes on a full charge. An extended battery life such as overnight use is not contemplated.

In U.S. Pat. No. 5,262,756 issued on Nov. 16, 1993, to Tseng L. Chien, a solar powered warning light apparatus containing a single rechargeable nickel-cadmium battery for intermittently flashing a xenon flash tube is described. The rechargeable battery has a limited cell voltage of 1.2 volts recharged by the four segments of the solar cell serving as a base for the inverted xenon tube. The use of a constant light beam and a larger capacity electrical source is not suggested.

In U.S. Pat. No. 4,626,852 issued on Dec. 2, 1986, to Robert J. Dodge, a buoy lantern having a solar panel positioned above the flashing light and a lampchanger system is described. The solar panel consists of 20 or 40 solar cells capable of 7.4 or 14.4 charging volts for a 12 volt system. By arrangement of a pair of parallel strings of 20 solar cells each, a 6 volt system is obtained. The buoy lantern requires a gimbal system.

In U.S. Pat. No. 5,039,929 issued on Aug. 13, 1991, to Rene Veistroffer et al., an automatic charger capable of charging several batteries is described.

In the German patent application No. DE 3,118,694 A1 published on Dec. 2, 1982, for Friedhelm Harnischmacher et al., a portable hand-lamp with a detachable charging unit by means of a magnet is described.

Finally, in the German PCT patent application No. WO 93/254,408 published on Dec. 23, 1993, for Sagrista I. Prats et al., a rechargeable pocket lamp detachably mounted inside a vehicle is described. The lamp has a swivellable permanent magnet which can be locked in several positions.

The disclosures of these prior art references are hereby incorporated by reference.

None of the above inventions and patents, taken either singly or in combination, is seen to describe the instant invention as claimed.

SUMMARY OF THE INVENTION

The present invention provides for a rechargeable portable fleet light suitable for lighting of connected barges or the like which are moored at dark. The Coast Guard requires mooring lights which are uncolored and visible in a 360° direction for at least one mile in darkness. The conventional barge lighting practice is the use of kerosene lamps and disposable six volt lantern batteries with pigtails. Kerosene lamps pose a fire hazard. On one occasion, a worker had refilled one lamp with gasoline, but lived to tell his story without serious injury. The cost of disposable batteries for a large fleet is not economical.

There is a need for a safe and economical rechargeable lighting system for moored barges or the like. The fleet light has components that are readily available. The clear plastic lens cover has a reflective surface on the inside of the flat top surface. A companion reflective surface is provided below the light bulb on the flat cover for the battery case. The immediate power source is a rechargeable battery within the case (which can be cylindrical or four-sided) connected to an on/off switch. The battery case has an electrical port for recharging purposes. Therefore, multiple fleet lights such as multiples of 24, 48, etc. can be recharged simultaneously during the day by utilizing the inventive multiple unit charger from a 110 or 220 volt source.

Another embodiment utilizes a solar cell module positioned above but contiguous to the lens cover to recharge the fleet light battery during the day.

A third embodiment utilizes a magnetic base contiguous to the battery case to enhance adhesion of the fleet light to metallized surfaces such as barge covers, deck and coamings. The magnet can alternatively be positioned on a side of a four-sided metal battery case or, preferably, fastened to the case, whether the case is metal or plastic.

Accordingly, it is a principal object of the invention to provide a rechargeable light system for use to mark moored barges or the like in darkness.

It is another object of the invention to provide a rechargeable lighting device having a 360° illumination capacity.

It is a further object of the invention to provide recharging of a single fleet light by a solar cell module positioned above the light bulb.

Still another object of the invention is to provide recharging of a single fleet light by a rechargeable nickel-cadmium or lithium battery.

It is another object of the invention to provide a magnetic base or side attachment for each rechargeable lighting device.

It is a final object of the invention to provide a recharger unit for recharging multiple charger units simultaneously.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
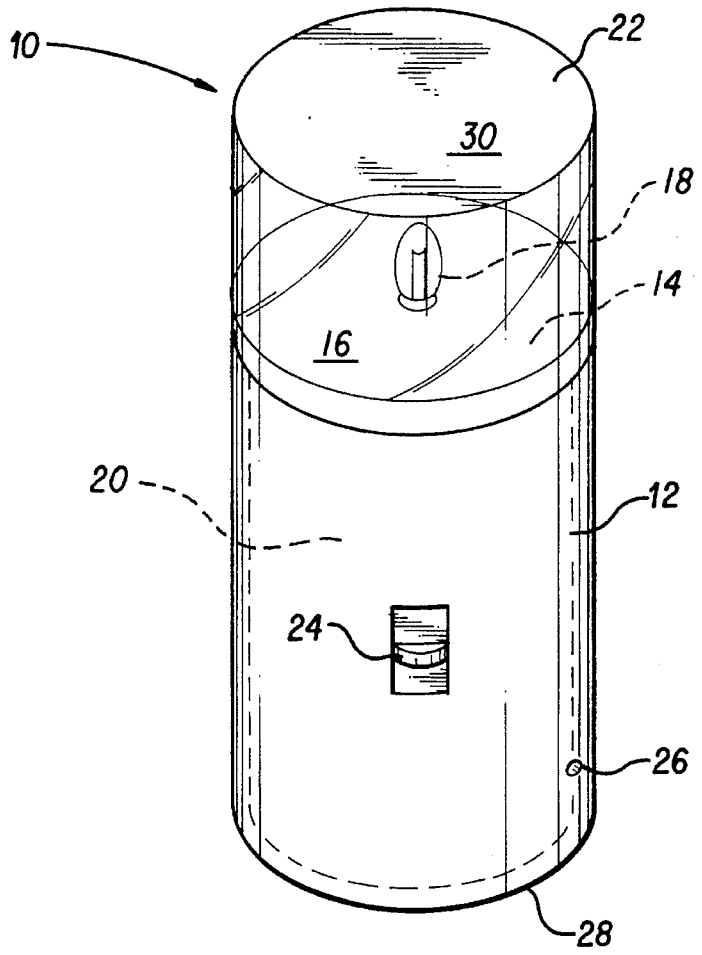
FIG. 1 is a perspective view of the first embodiment of the fleet light.

The first embodiment of a fleet light is illustrated in FIG. 1. Fleet light 10 in its simplest form consists of a cylindrical plastic or metal case 12 having a plastic or metal case cover 14 which has a reflective (silvered) top surface 16 and a centrally mounted light bulb 18. The case cover 14 is suitably threaded (not shown) to mate with the internal threading (not shown) of the case 12 in order to insert or change the rechargeable battery 20. The light bulb 18 is covered with a cylindrical lens cover 22 made of either clear plastic such as Lexan™ (a polycarbonate) or glass. The case 12 can be rectangular or squarish in shape (not shown), i.e., four-sided, in order to accommodate a similarly shaped rechargeable battery.

The rechargeable battery 20 can be a single 6 D.C. volt battery or a series-connected two 3 volt batteries or four 1.5 volt batteries. If the case 12 is four-sided, attachment means other than threading would be provided, such as a friction fitting four-sided cover 14 (not shown). Case 12 has an on/off switch 24 to operate the bulb 18, which could be a standard six volt flashlight lamp or, for example, a krypton gas filled bulb for greater brilliance. A female socket 26 is also located proximate to the base 28 of case 12 for a recharger plug connection (not shown). The lens cover 22 has preferably a cylindrical shape in order to enhance the 360° illumination required by the authorities. The inner top surface 30 of lens cover 22 also has a reflecting surface such as a silvered coating. The two silvered surfaces 16 and 30 thus reflect all the emitted light through the sides of the clear plastic or glass lens cover 22. The cylindrical shape of the lens cover together with an overall cylindrical shape of the fleet light 10 is advantageous in that the wind resistance of a fleet light is significantly decreased and the stability of a fleet light is correspondingly increased. The fleet light 10 can be placed in base holders of suitable diameter and height (not shown) installed permanently on the covers or deck of the barge.

Figure 2:
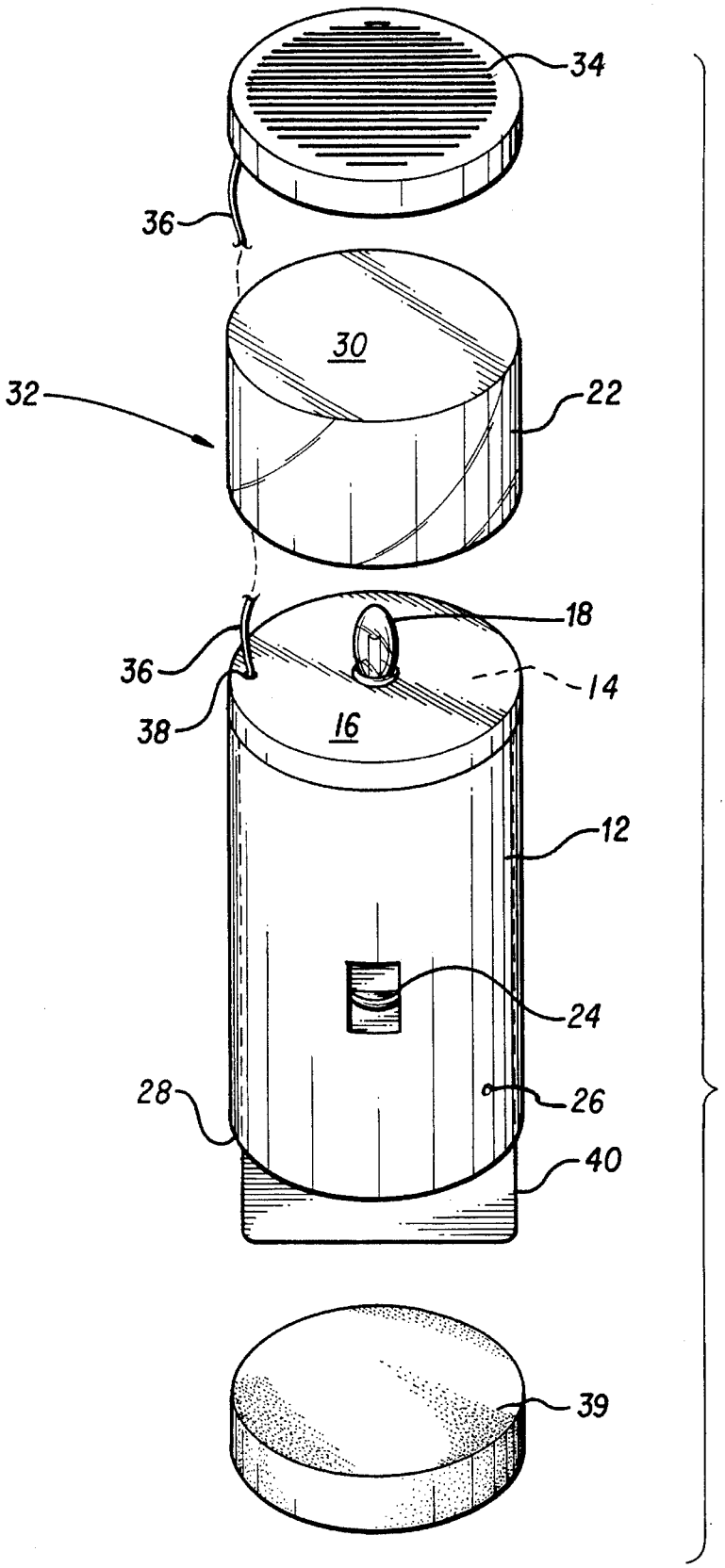
FIG. 2 is an exploded perspective view of the second embodiment of the fleet light.

A second embodiment is illustrated in FIG. 2, wherein a fleet light 32 has a solar cell 34 consisting of a doped silicon or gallium arsenide substrate in wafer form having a diameter of approximately 3 to 5 inches. The doped silicon or gallium arsenide wafer is positioned on top of the lens cover 22 by any fastening means such as gluing and the circuit wire 36 is connected to the battery 40 through an aperture 38 in a peripheral region of the case cover 14. The silicon wafer can conveniently shade the bulb 18 and the case cover 14 from harmful sunlight while the solar cell is being energized. Therefore, it is contemplated that an oversized wafer can be utilized for an increase in regeneration capability and shading. A 6 volt four-sided battery 40 is illustrated to show the adaptability of battery case 12 in that the shape of the battery need not be the same as the shape of the battery case 12, and, therefore, cylindrical batteries can also be used.

A magnetic base 39 is attached to the base 28 of battery case 12 by any fastening means such as gluing if the battery case 12 is plastic. No fastening means is necessary if the battery case 12 is metallic, but may be desirable under adverse weather conditions. Even when the battery case is metallic, it is preferable to firmly glue or otherwise fasten the magnetic base 39 to the battery case 12 to assure the two parts will not become separated when the light is, for example, picked up and moved. The shape of the magnetic base 39 is preferably similar to the shape of the base 28. Thus, the fleet light 32 in this second embodiment can operate on sunlight and be positioned securely by magnetic base 39 in the appropriate positions on a coaming or deck of each barge in the fleet.

Figure 3:
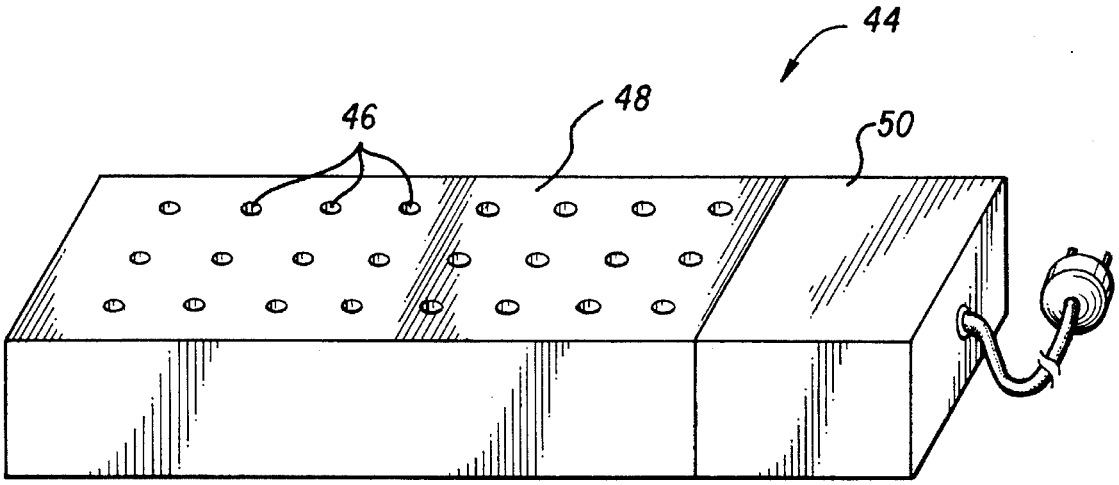
FIG. 3 is a perspective view of a multiple charger recharging unit.

When there is insufficient sunlight to provide adequate regeneration of power for the rechargeable battery 40, the fleet light unit 32 can still be regenerated by the multiple charger device 44 illustrated in FIG. 3. The multiple fleet light charger 44 has 24 plug-in or female sockets 46 in the charger portion 48. The number of sockets 46 is exemplary in that multiples of 24 such as 48 and 72 are contemplated. Integral with the charger portion 48 is the A.C. to D.C. converter-transformer 50 for converting the 110–220 volt A.C. house current to a 6 volt direct current source for recharging the electrically depleted fleet lights en masse. Connecting electrical wires having male plugs at each end (not shown) are utilized in the charging process.

Figure 4:
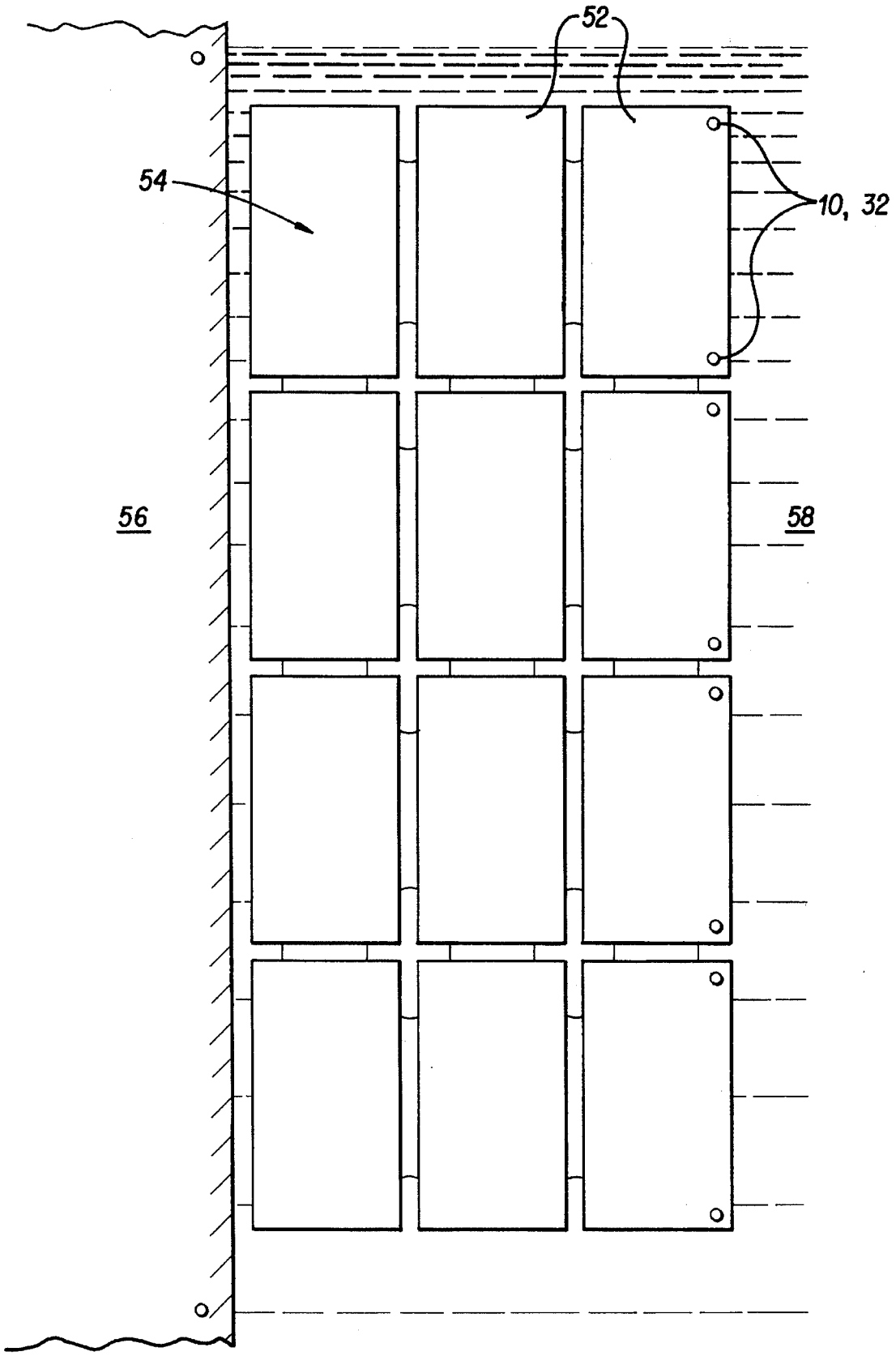
FIG. 4 is a plan view of three tiers of connected barges having fleet lights.

It is noted that river barges are normally grouped in numbers as high as 100 to 200 requiring approximately 134 to 266 fleet lights 10. It can be seen by these large quantities, servicing of fleet lights becomes a serious economic factor. In FIG. 4, 12 river barges 52 are illustrated having 3 barges in a tier 54 of 3 tiers which are tied together at their mooring at a dock 56. Fleet lights 10 (or 32) are required to be posted at the bow and stern of each outside barge 52 on the river 58 facing the river traffic.

It can be readily appreciated that the portable and rechargeable fleet light of this invention can be quickly deployed and removed for regeneration of power at a fraction of the cost for maintaining a large quantity of kerosene lamps or flashlights now being utilized.

It is to be understood that the present invention is not limited to the embodiments described above, but encompasses any and all embodiments within the scope of the following claims.

I claim:

1. A combination of a rechargeable barge light and a multiple barge fleet light recharging device for illuminating moored barges comprising:

a cylindrical barge fleet light unit including:

a cylindrical cover lens selected from plastic or glass having a flat top surface which is reflective, a clear cylindrical side and an open bottom;

a light bulb being centrally positioned inside said cover lens and horizontally illuminating 360°;

said light bulb being centrally positioned in and secured by a cylindrically shaped flat battery case cover;

said flat battery case cover having a reflective surface and being adapted to secure said cover lens and a cylindrical battery case; and said battery case containing at least one rechargeable battery, whereby a moored barge fleet is adequately illuminated to warn any passing traffic; and a multiple barge fleet light unit charger device comprising;

a rectangular direct current charger adapted to charge a fleet number of rechargeable barge fleet light units selected from twenty-four and forty-eight, and integrated with an A.C. to D.C. converter; whereby the rechargeable barge fleet light units are recharged simultaneously for the next operation of illumination required.

2. The combination of a rechargeable barge fleet light and a multiple barge fleet light recharging device according to claim 1, wherein said cylindrical cover lens is made of polycarbonate.

3. The combination of a rechargeable barge fleet light and a multiple barge fleet light recharging device according to claim 1, wherein said cylindrical cover lens is made of glass.

4. The combination of a rechargeable barge fleet light and a multiple barge fleet light recharging device according to claim 1, wherein said battery case has an on/off switch to regulate the energizing of said light bulb.

5. The combination of a rechargeable barge fleet light and a multiple barge fleet light according to claim 1, wherein said battery case has a female socket located proximate to its base to enable recharging by said multiple unit charger.

6. The combination of a rechargeable barge fleet light and a multiple barge fleet light according to claim 1, wherein said light bulb is filled with krypton gas.

7. The combination of a rechargeable barge fleet light and a multiple barge fleet light according to claim 1, wherein said rectangular direct current charger has female sockets for connection with a multiple number of said rechargeable fleet lights.

8. The combination of a rechargeable barge fleet light and a multiple barge fleet light according to claim 1, wherein a solar cell is fastened on top of said lens cover to energize a depleted battery and shade the light bulb.

9. The combination of a rechargeable barge fleet light and a multiple barge fleet light recharging device according to claim 8, wherein said solar cell is selected from a doped substrate of silicon and gallium arsenide.

10. The combination of a rechargeable barge fleet light and a multiple barge fleet light recharging device according to claim 1, further comprising a magnet attached to a base of said battery case, whereby said rechargeable fleet light is magnetically attached to one of a coaming and a deck of a moored barge.

* * * * *